US006698743B2

(12) United States Patent
Kuramoto et al.

(10) Patent No.: US 6,698,743 B2
(45) Date of Patent: Mar. 2, 2004

(54) DETERMINING WHEN ADHESIVE IN A REPLACEABLE ADHESIVE DISPENSER IS NEARLY SPENT

(75) Inventors: Akinobu Kuramoto, Pleasanton, CA (US); Robert L. Cobene, Santa Clara, CA (US); John P. Ertel, Portola Valley, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/289,871

(22) Filed: Nov. 6, 2002

(65) Prior Publication Data

US 2003/0063963 A1 Apr. 3, 2003

Related U.S. Application Data

(60) Division of application No. 09/837,648, filed on Apr. 18, 2001, which is a continuation-in-part of application No. 09/721,549, filed on Nov. 24, 2000.

(51) Int. Cl.[7] ..... B42C 9/00

(52) U.S. Cl. ..... 270/58.09; 270/58.09; 412/37; 412/8; 412/11

(58) Field of Search ..... 270/58.07, 58.08, 270/58.09; 412/8, 11, 14, 20, 37, 901

(56) References Cited

U.S. PATENT DOCUMENTS

| | | | | |
|---|---|---|---|---|
| 4,150,770 A | | 4/1979 | Wieland, Jr. et al. | |
| 4,406,247 A | | 9/1983 | Baughman et al. | |
| 4,473,425 A | | 9/1984 | Baughman et al. | |
| 4,540,458 A | | 9/1985 | Baughman et al. | |
| 4,707,215 A | | 11/1987 | Scarlata | |
| 5,052,873 A | * | 10/1991 | Parker et al. | 412/13 |
| 5,193,962 A | | 3/1993 | Parker et al. | |
| 5,194,116 A | | 3/1993 | Davis et al. | |
| 5,613,711 A | * | 3/1997 | Parker | 281/21.1 |
| 5,632,853 A | | 5/1997 | Montandon, Jr. et al. | |
| 5,833,423 A | * | 11/1998 | Yamaguchi et al. | 412/8 |
| 5,980,676 A | * | 11/1999 | Meetze | 156/216 |
| 6,065,884 A | * | 5/2000 | Parker et al. | 101/29 |
| 6,196,651 B1 | | 3/2001 | Zuber et al. | |
| 2002/0131847 A1 | * | 9/2002 | Parker | 412/33 |

FOREIGN PATENT DOCUMENTS

| | | | | |
|---|---|---|---|---|
| JP | 06115278 A | * | 4/1994 | B42C/9/02 |
| JP | 06115279 A | * | 4/1994 | B42C/9/02 |
| JP | 10305672 A | * | 11/1998 | B42C/9/02 |

* cited by examiner

*Primary Examiner*—Patrick Mackey

(57) ABSTRACT

Systems and methods of determining when adhesive in a replaceable adhesive dispenser is nearly spent are described. In one aspect, a bookbinding system includes a receptacle for receiving a plug-in cartridge housing of an adhesive dispenser that contains a length of solid sheet adhesive wound into a roll, and an adhesive quantity interrogator that is configured to obtain an indication of the length of solid sheet adhesive remaining within the plug-in cartridge housing. In another aspect, an adhesive dispenser includes a plug-in cartridge housing that is configured to plug into a receptacle of a bookbinding system, a length of solid sheet adhesive that is disposed within the plug-in cartridge housing and wound into a roll, and an indicator of the length of solid sheet adhesive remaining within the plug-in cartridge housing.

13 Claims, 9 Drawing Sheets

DETERMINING WHEN ADHESIVE IN A REPLACEABLE ADHESIVE DISPENSER IS NEARLY SPENT

CROSS REFERENCE TO RELATED APPLICATION(S)

This is a divisional of copending application Ser. No. 09/837,648 filed on Apr. 18, 2001, which is a continuation-in-part of copending application Ser. No. 09/721,549, filed on Nov. 24, 2000. which is hereby incorporated by reference herein.

TECHNICAL FIELD

This invention relates to systems and methods of determining when adhesive in a replaceable adhesive dispenser is nearly spent.

BACKGROUND

Today, a variety of different bookbinding systems can deliver professionally bound documents, including books, manuals, publications, annual reports, newsletters, business plans, and brochures. A bookbinding system generally may be classified as a commercial (or trade) bookbinding system that is designed for in-line manufacturing of high quality volume runs or an in-house (or office) bookbinding system designed for short "on-demand" runs. Commercial bookbinding systems generally provide a wide variety of binding capabilities, but require large production runs (e.g., on the order of thousands of bindings) to offset the set-up cost of each production run and to support the necessary investment in expensive in-line production equipment. Office bookbinding systems, on the other hand, generally involve manual intervention and provide relatively few binding capabilities, but are significantly less expensive to set up and operate than commercial bookbinding systems, even for short on-demand production runs of only a few books.

In general, a bookbinding system collects a plurality of sheets (or pages) into a text body (or book block) that includes a spine and two side hinge areas. The bookbinding system applies an adhesive to the text body spine to bind the sheets together. A cover may be attached to the bound text body by applying an adhesive to the side hinge areas or the spine of the text body, or both. The cover of a typical commercial soft cover book generally is attached to the text body spine. The covers of hardcover books and some soft cover "lay flat" books, on the other hand, typically are attached to the side hinge areas of the text body and are not attached to the text body spines (i.e., the spines are "floating").

Many different systems have been proposed for providing replaceable adhesive cartridges for bookbinding systems.

For example, U.S. Pat. No. 5,632,853 describes a desktop bookbinding device for binding a stack of sheets along a stack edge using a cold set aqueous adhesive. The desktop bookbinding device is an office system having a liquid adhesive storing compartment that is connected to a disposable, non-refillable liquid adhesive cartridge, which includes an applicator belt. The applicator belt applies liquid adhesive to the stack edge when a carriage drives the cartridge along the stack of sheets.

U.S. Pat. No. 4,540,458 describes a booklet binding system in which a set of sheets is delivered seriatim along a sheet path leading from an input station to an assembly station where a booklet is formed. As a sheet is moved along the path, a line of liquid adhesive is applied to one surface of the sheet adjacent to one side of the sheet. The adhesive dispensing system includes a replaceable, pressurizable cartridge of liquid adhesive. An emitter and a detector are located in the cartridge holder and are configured to provide a signal to a system controller that indicates that the level of liquid adhesive in the cartridge is above or below the lower end of the cartridge. In the assembly station, the sheets are jogged to align the sheets of the set and pressure is applied to the sheets over the line of liquid adhesive. When the entire set has been bound together into a booklet, the booklet is removed from the assembly station and delivered to an output station.

Still other bookbinding systems have been proposed.

SUMMARY

The invention features novel systems and methods of determining when adhesive in a replaceable adhesive dispenser is nearly spent.

In one aspect, the invention features a bookbinding system that includes a receptacle for receiving a plug-in cartridge housing of an adhesive dispenser containing a length of solid sheet adhesive wound into a roll, and an adhesive quantity interrogator that is configured to obtain an indication of the length of solid sheet adhesive remaining within the plug-in cartridge housing.

Embodiments in accordance with this aspect of the invention may include one or more of the following features.

In one embodiment, the adhesive quantity interrogator is configured to interrogate a memory device that is mounted on the plug-in adhesive cartridge and is programmed to store an indication of the length of solid sheet adhesive remaining within the plug-in cartridge housing. The adhesive quantity interrogator may be configured to store in the memory device an indication of the length of solid sheet adhesive remaining within the plug-in cartridge housing.

In some embodiments, the adhesive quantity interrogator comprises a sensor that is configured to sense when the solid sheet adhesive within the plug-in cartridge housing is nearly spent.

The sensor may be configured to optically sense when the solid sheet adhesive is nearly spent. For example, the sensor may be configured to sense when the solid sheet adhesive is nearly spent based upon a light signal transmitted toward a side of the roll of solid sheet adhesive. Alternatively, the sensor may be configured to sense when the solid sheet adhesive is nearly spent based upon a light signal transmitted toward an exposed surface of solid sheet adhesive. In some embodiments, the sensor is configured to sense when the solid sheet adhesive is nearly spent based upon a change in light response of the exposed surface of solid sheet adhesive. In other embodiments, the sensor is configured to sense when the solid sheet adhesive is nearly spent based upon detection of an information-containing symbol disposed on the exposed surface of the solid sheet adhesive.

In one embodiment, the sensor is configured to magnetically sense when the solid sheet adhesive is nearly spent based upon detection of a magnetic indicator that is disposed near an end of the solid sheet adhesive.

In another embodiment, the sensor is configured to physically sense when the solid sheet adhesive is nearly spent based upon contact between a probe and a surface of the roll of solid sheet adhesive. The probe preferably is configured to remain in contact with the surface of the roll of solid sheet adhesive by turning on a pivot. The sensor may be configured to sense the length of solid sheet adhesive remaining within the plug-in cartridge housing based upon an angle at which the probe turns on the pivot. The angle at which the probe turns on the pivot may be measured based upon an electrical resistance measurement.

In another aspect, the invention features an adhesive dispenser that includes a plug-in cartridge housing that is configured to plug into a receptacle of a bookbinding system, a length of solid sheet adhesive that is disposed within the plug-in cartridge housing and wound into a roll, and an indicator of the length of solid sheet adhesive remaining within the plug-in cartridge housing.

Embodiments in accordance with this aspect of the invention may include one or more of the following features.

The length indicator may comprise a memory device that is mounted on the plug-in adhesive cartridge and is programmed to store an indication of the length of solid sheet adhesive remaining within the plug-in cartridge housing.

The length indicator may comprise an interrogatable feature that is disposed on an exposed surface of the solid sheet adhesive. The interrogatable surface feature may comprise a change in light response of the exposed surface of solid sheet adhesive, an information-containing symbol disposed on the exposed surface of the solid sheet adhesive, or a magnetic indicator disposed near an end of the solid sheet adhesive.

Other features and advantages of the invention will become apparent from the following description, including the drawings and the claims.

DETAILED DESCRIPTION

In the following description, like reference numbers are used to identify like elements. Furthermore, the drawings are intended to illustrate major features of exemplary embodiments in a diagrammatic manner. The drawings are not intended to depict every feature of actual embodiments nor relative dimensions of the depicted elements, and are not drawn to scale.

Figure 1:
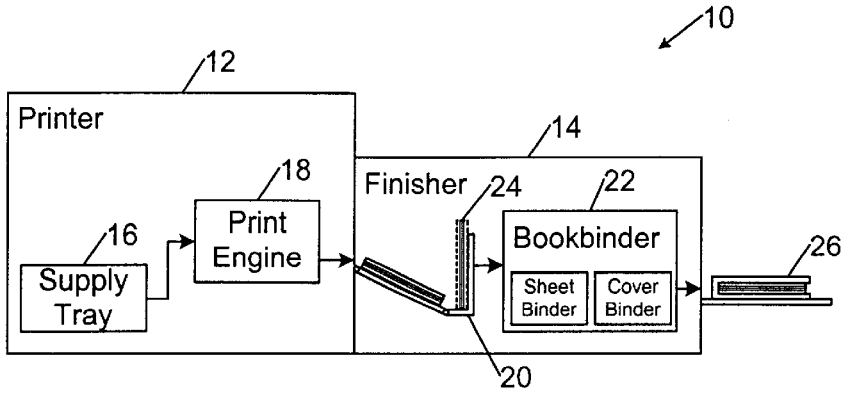
FIG. 1 is a diagrammatic side view of a bookbinding system.

Referring to FIG. 1, in one embodiment, a bookbinding system 10 includes a printer 12 and a finisher 14. Bookbinding system 10 may be implemented as a desktop or office bookmaking system designed to satisfy on-demand bookbinding needs. Printer 12 may be a conventional printer (e.g., a LaserJet® printer available from Hewlett-Packard Company of Palo Alto, Calif., U.S.A.) that includes a supply tray 16 that is configured to hold a plurality of sheets (e.g., paper sheets), and a print engine 18 that is configured to apply markings onto the sheets received from supply tray 16. Finisher 14 includes a sheet collector 20 and a bookbinder 22. Bookbinder 22 includes a sheet binder that is configured to bind the text body sheets to one another, and a cover binder that is configured to attach a cover to the bound text body. In operation, sheets are fed from supply tray 16 to print engine 18, which prints text, pictures, graphics, images and other patterns onto the sheets. The printed sheets are fed to sheet collector 20, which collects and aligns the sheets into a text body 24 with an exposed spine bounded by two exposed side hinge areas. The text body 24 is conveyed to bookbinder 22. The sheet binder binds the sheets of text body 24, and the cover binder attaches a cover to the bound text body to produce a bound book 26 with a floating spine or an attached spine.

Figure 2A:
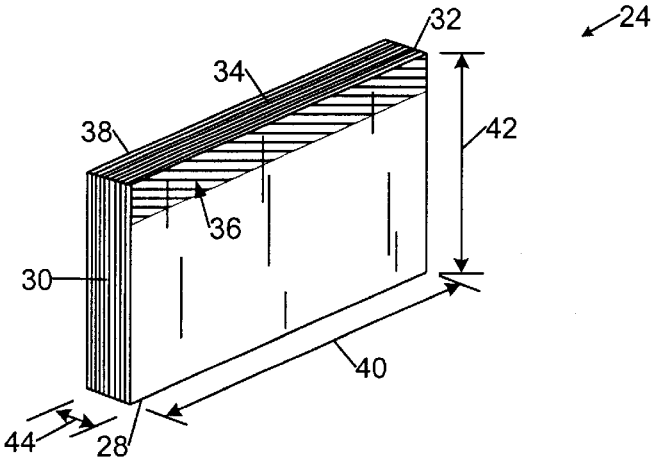
FIG. 2A is a diagrammatic perspective view of a text body formed by collecting and aligning a plurality of sheets.
Figure 2B:
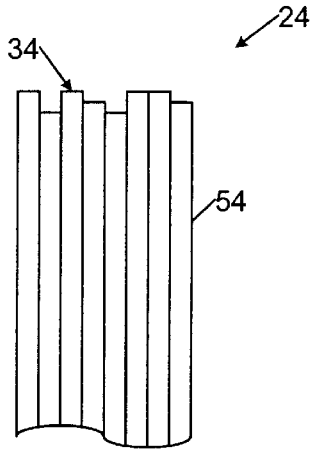
FIG. 2B is a diagrammatic end view of the spinal portion of a text body formed by registering sheets with respect to two datum edges so that variations in sheet width dimension are accommodated in the spine edge of the text body.

Referring to FIGS. 2A and 2B, text body 24 includes a plurality of sheets and is characterized by a front end 28, two sides 30, 32 and a spinal area (or spine) 34, which is located opposite to front end 28. Spine 34 is bounded by two side hinge areas 36, 38. Text body 24 may be characterized by a height dimension 40, a width dimension 42, and a thickness dimension 44. As shown in FIG. 2B, the spinal area exposed for adhesive penetration may be increased before adhesive is applied by registering and aligning text body sheets 54 with respect to two datum edges. In particular, sheets 54 preferably are aligned with reference to front end 28 of text body 24 and one of the two text body sides 30, 32 so that variations in sheet dimensions are accommodated in the text body width dimension 42 of spinal area 34. As a result, the spinal surface area exposed for adhesive penetration is greater than if all of the sheets 54 were registered and aligned with respect to spine edge 34. Upon cooling, the hot melt adhesive re-solidifies and binds the sheets 54 into a bound text body. A variety of different hot melt adhesive compositions may be used to bind the text body sheets, including a conventional paper-backed hot melt sheet adhesive that may be dispensed from a roll and may be obtained from Minnesota Mining and Manufacturing Company (3M), of St. Paul, Minn., United States.

Figure 3:
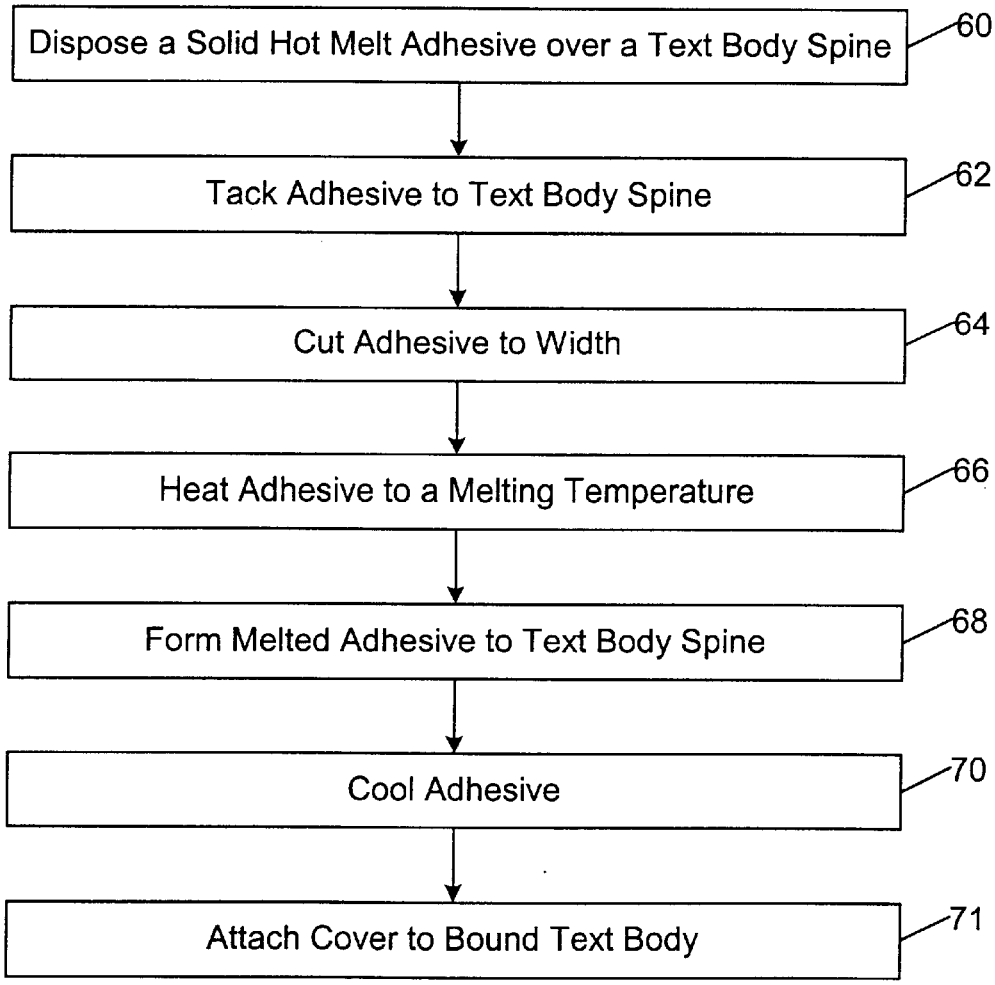
FIG. 3 is a flow diagram of a method of binding sheets into a bound text body.

Referring to FIG. 3, in one sheet binding embodiment, text body 24 may be bound as follows. An adhesive dispensing system disposes a solid hot melt adhesive over text body spine 34 (step 60). A spot heater tacks the dispensed adhesive to the text body spine (step 62). The adhesive dispensing system cuts the adhesive to width, leaving a preformed solid hot melt adhesive tacked to text body spine 34 (step 64). An adhesive heater heats the preformed solid hot melt adhesive to a temperature at or above the melting temperature of the adhesive (step 66). The melted adhesive conforms to the exposed surface features of spinal area 34 and flows into spaces between the ends of sheets 54. An adhesive former forms the melted adhesive to text body spine 34 (step 68). An adhesive cooler cools the formed adhesive until the adhesive re-solidifies to bind the text body sheets into a bound text body (step 70). The resulting bonds between text body sheets 54 are greater than the bonds that would have been formed had the sheets been registered and aligned at spine edge 34. Next, a cover is attached to the bound text body to form a bound book with a floating spine or an attached spine (step 71).

As shown in FIGS. 4A–4D, in one embodiment, an adhesive dispensing system 72 includes a cartridge housing 74 that includes a supply spool 76 supporting a roll of a paper-backed solid hot melt adhesive 78. Cartridge housing 74 may plug into a corresponding receptacle in bookbinder 22 of finisher 14. Hot melt adhesive 78 is dispensed through a guide slot 80 formed in housing 74. Opposed drive wheels 82, 84 draw hot melt adhesive 78 through guide slot 80. Adhesive dispensing system 72 also includes a spot heater 86 that is configured to heat one or more localized areas of hot melt adhesive 78 to a temperature that is sufficient to tack the adhesive to text body spine 34. Spot heater 86 includes an elongated clamp 88 that supports one or more exposed spaced-apart heating elements (e.g., conventional heating strips or resistive wires). The spacing between heating elements may be on the order of 1–4 cm. A cutting wheel 90 is configured to cut hot melt adhesive 78 to width by traversing a cutting edge of a cutter bar 92.

Figure 4A:
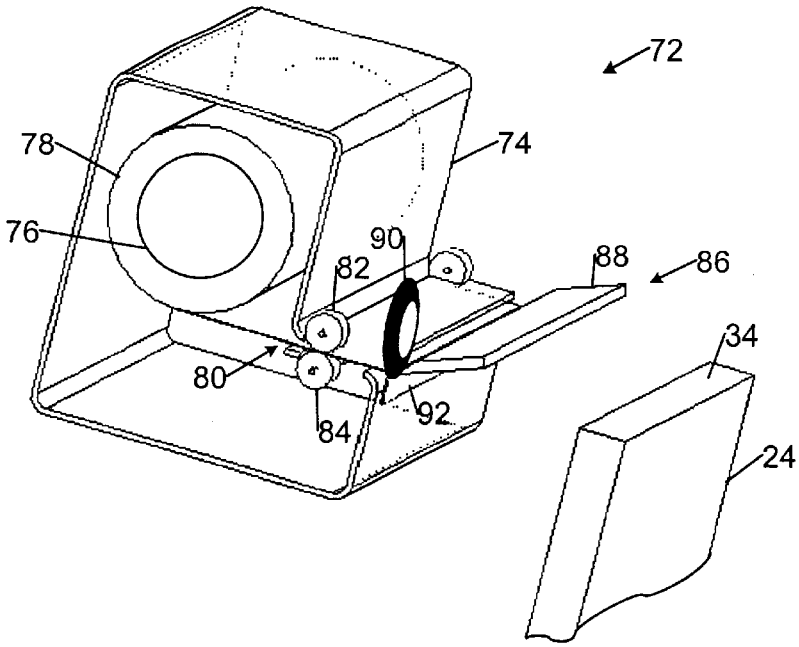
FIG. 4A is a diagrammatic perspective view of an adhesive dispensing system that incorporates a spot heater that is configured to tack a solid hot melt adhesive to a text body spine.
Figure 4B:
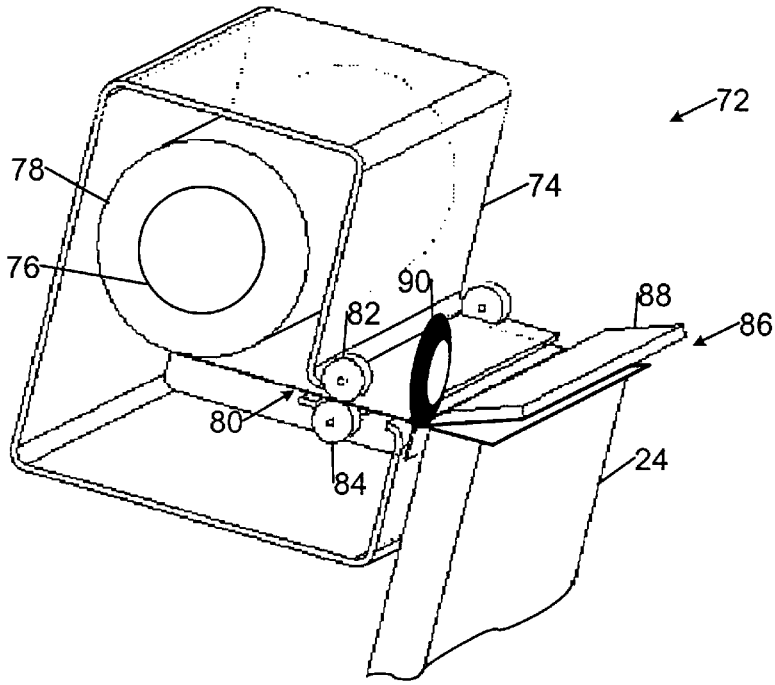
FIG. 4B is a diagrammatic perspective view of the adhesive dispensing system of FIG. 4A disposing a solid hot melt adhesive over a text body spine.
Figure 4C:
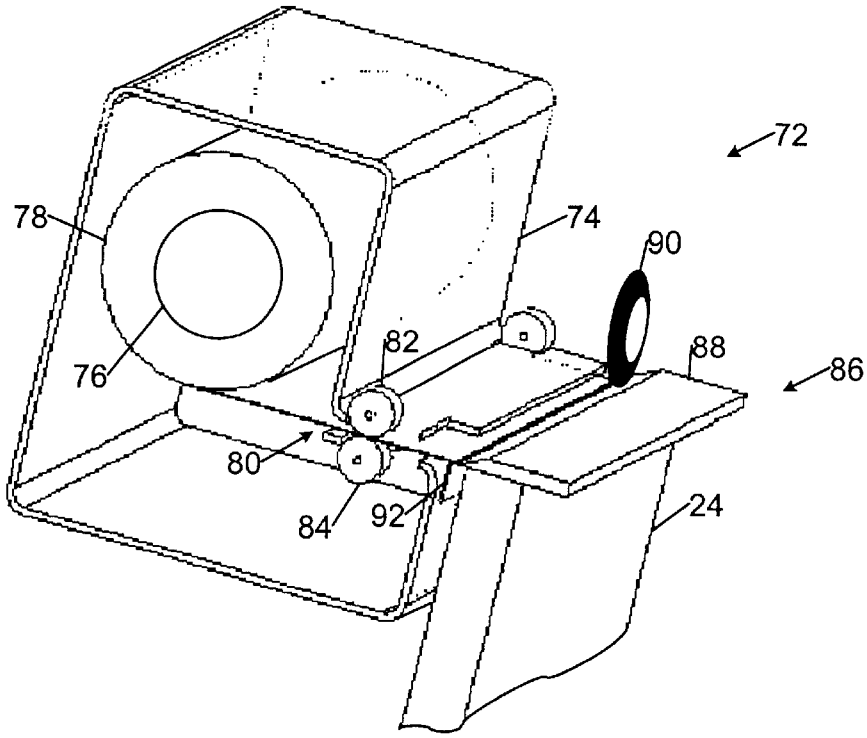
FIG. 4C is a diagrammatic perspective view of the spot heater of FIG. 4A tacking the dispensed solid hot melt adhesive to the text body spine and a cutting wheel cutting the tacked adhesive to width.
Figure 4D:
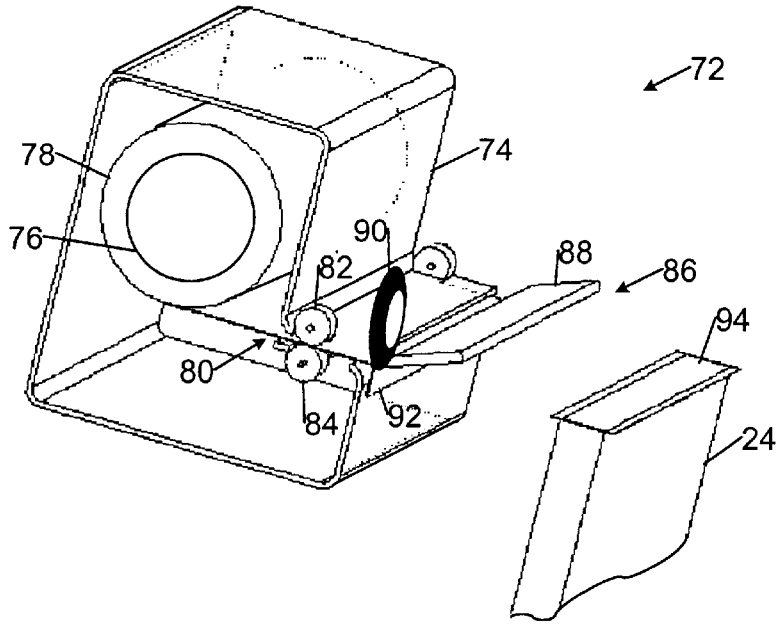
FIG. 4D is a diagrammatic perspective view of the adhesive dispensing system of FIG. 4A and a preformed solid hot melt adhesive tacked to the text body spine.

As shown in FIG. 4B, in operation, adhesive dispensing system 72 is brought into contact with a clamping system (not shown) that holds text body 24 in place. Drive wheels 82, 84 dispense hot melt adhesive 78 over text body spine 34 to a desired width. In one embodiment, an optical sensor may be configured to stop drive rollers 82, 84 upon detection of when the leading edge of hot melt adhesive 78 has passed over text body spine 34 by a desired amount. Referring to FIG. 4C, after hot melt adhesive 78 has been disposed over text body spine 34, spot heater 86 clamps hot melt adhesive 78 to text body spine 34 and cutting wheel 90 cuts hot melt adhesive 78 to width. Spot heater 86 holds hot melt adhesive 78 in place while the adhesive is being cut and applies sufficient heat and pressure to tack the adhesive to text body spine 34 at one or more locations. After hot melt adhesive 78 has been tacked in place, the heating elements of spot heater 86 may be turned off and adhesive dispensing system 72 may be withdrawn (FIG. 4D). The tack bond holds the resulting preformed hot melt adhesive 94 to text body spine 34 with sufficient force to prevent preformed hot melt adhesive 94 from becoming displaced during subsequent processing steps and to prevent the sheets of text body 24 from moving.

Preformed hot melt adhesive 94 may be processed to bind text body 24 by a compact, multi-function sheet binder, as described in U.S. Ser. No. 09/776,251, filed Feb. 3, 2001. In particular, the multi-function sheet binder is configured to melt the preformed hot melt adhesive, form the melted adhesive, and actively cool the formed hot melt adhesive. A cover may be attached to the resulting bound text body as follows.

Figure 5A:
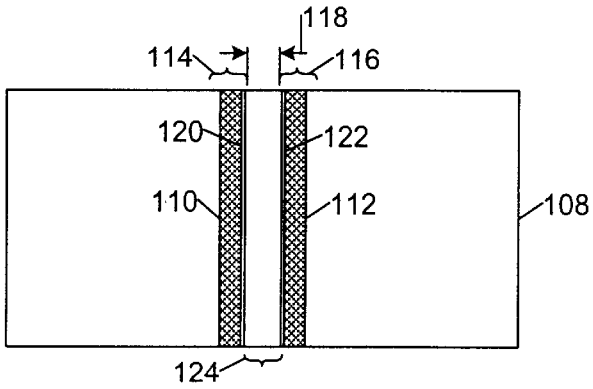
FIG. 5A is a diagrammatic front view of a cover with two strips of pressure sensitive adhesive applied to areas corresponding to the side hinge areas of a bound text body.
Figure 5B:
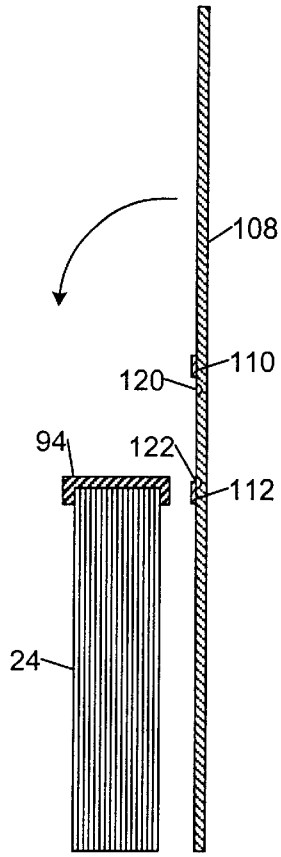
FIG. 5B is a diagrammatic end view of the cover of FIG. 5A being folded over the bound text body of FIG. 5A.
Figure 5C:
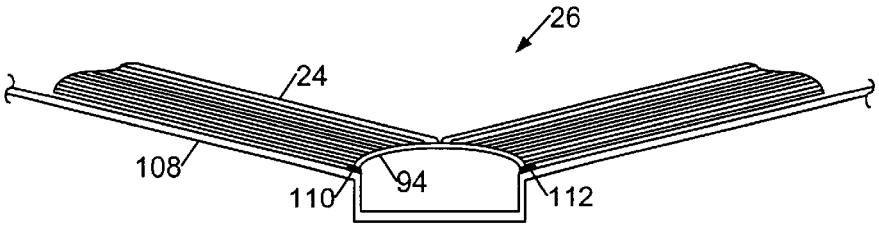
FIG. 5C is a diagrammatic end view of an open bound book with a floating spine formed by attaching the cover of FIG. 5A to the bound text body of FIG. 5A.

Referring to FIGS. 5A–5C, in one embodiment, a solid pressure sensitive adhesive film is applied to a cover 108 as two strips 110, 112 in cover areas 114, 116 that correspond to side hinge areas 36, 38 of text body 24. Pressure sensitive adhesive strips 110, 112 are spaced apart by a width dimension 118 that is at least as wide as the thickness dimension 44 of text body spine 34. As shown in FIG. 5B, cover 108 is aligned with respect to the same datum edges used to align the sheets of text body 24, cut to size, and folded over the bound text body 24. Cover 108 preferably is scored along a pair of score lines 120, 122 to allow cover 108 preferentially to fold over spinal area 34 of text body 24. Pressure is applied to cover areas 114, 116 to activate pressure sensitive adhesive strips 110, 112 and, thereby, attach cover 108 to text body 24. As shown in FIG. 5C, the resulting perfectly bound book 26 has a floating spine that enables the book 26 to lay flat when opened.

Figure 6:
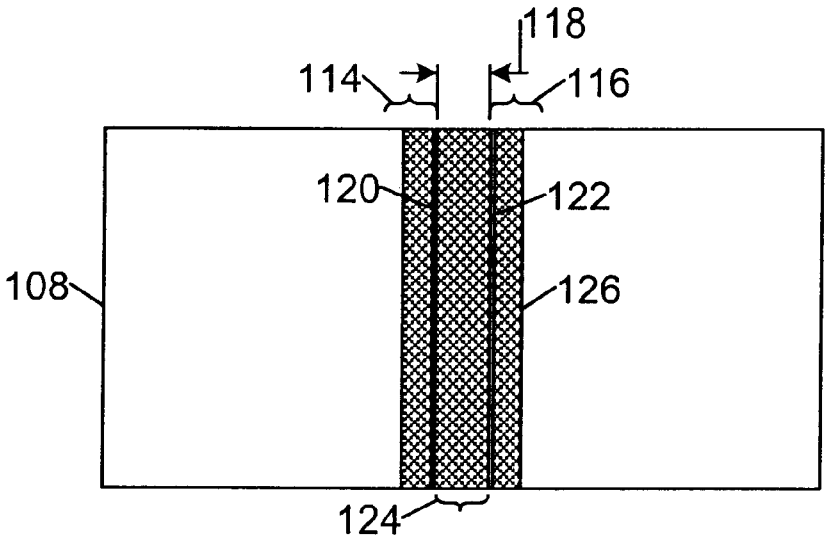
FIG. 6 is a diagrammatic front view of a cover with a single strip of pressure sensitive adhesive applied to an area corresponding to the spine and side hinge areas of the bound text body of FIG. 5A.
Figure 7:
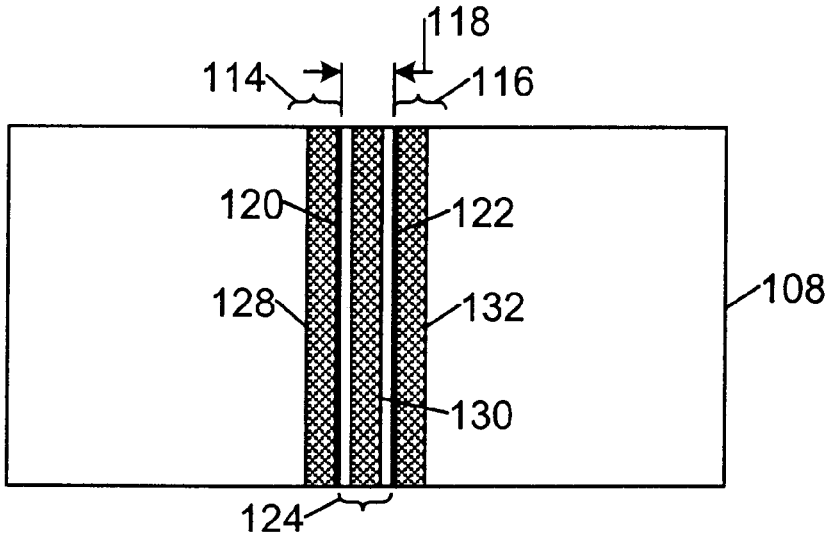
FIG. 7 is a diagrammatic front view of a cover with multiple strips of pressure sensitive adhesive applied to an area corresponding to the spine and side hinge areas of the bound text body of FIG. 5A.

As shown in FIGS. 6 and 7, text body 24 may be bound to cover 108 with an attached spine construction by applying a solid pressure sensitive adhesive film to a cover area 124 that corresponds to text body spine 34. The solid pressure sensitive adhesive film may be applied as a single continuous strip 126 over cover areas 114, 116, and 124 (FIG. 6), or in a series of multiple strips 128, 130, 132 over cover areas 114, 116, and 124 (FIG. 7).

As used herein, "pressure sensitive adhesives" refer to a class of adhesive compositions that are applied with pressure and generally do not undergo a liquid to solid transition in order to hold materials together. Pressure sensitive adhesives may be solvent-free natural or synthetic resins characterized by the rapid wetting of a surface to form an adhesive bond upon contact with the surface under pressure.

Figure 8A:
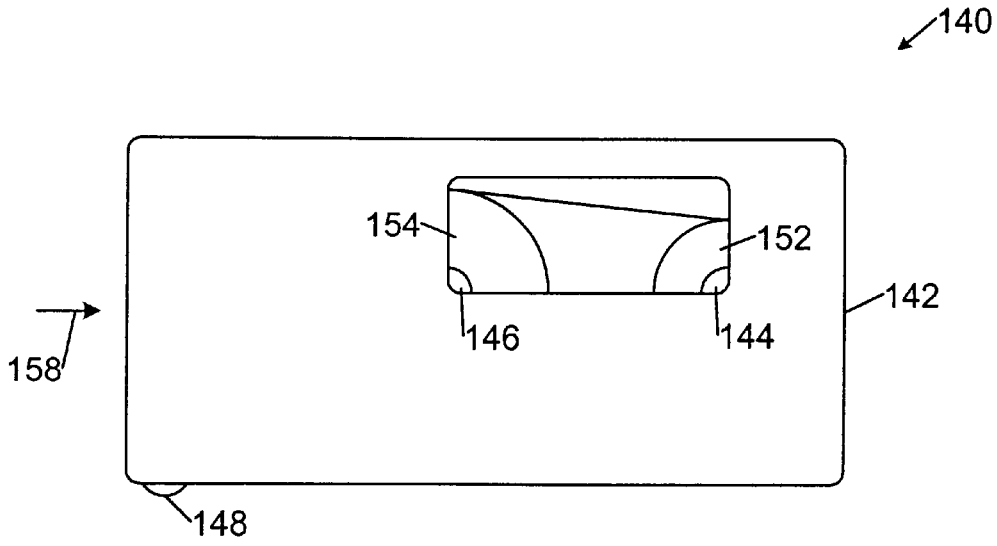
FIG. 8A is a diagrammatic side view of a plug-in adhesive dispenser for applying solid pressure sensitive adhesive film to a book cover.
Figure 8B:
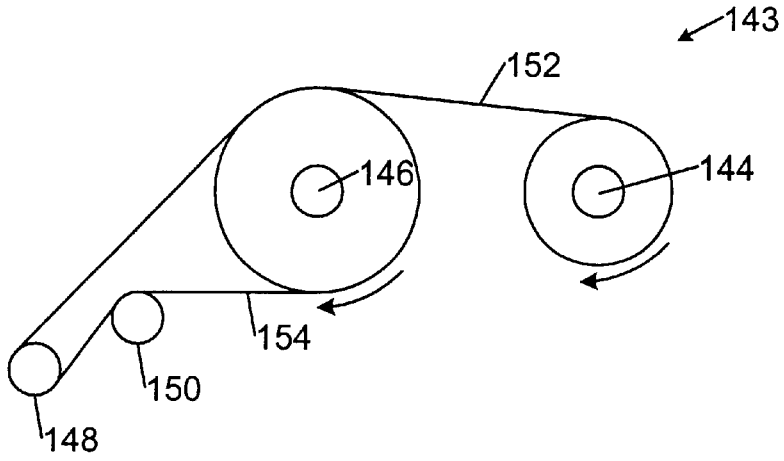
FIG. 8B is a diagrammatic side view of an adhesive dispensing mechanism of the plug-in adhesive dispenser of FIG. 8A, including a supply spool supporting a roll of a sheet adhesive formed from a solid pressure sensitive adhesive film composition disposed on a carrier ribbon, and a take-up spool configured to reel-in spent carrier ribbon.

Referring to FIGS. 8A and 8B, in one embodiment, pressure sensitive adhesive strips may be applied to cover 108 by an adhesive dispenser 140 that includes a plug-in cartridge housing 142 and an adhesive dispensing mechanism 143. Cartridge housing 142 may plug into a corresponding receptacle in bookbinder 22 of finisher 14. In some embodiments, multiple adhesive dispensers 140 may be stacked and loaded into bookbinder 22. The plug-in receptacle is located on a positioning mechanism that draws adhesive dispenser 140 across selected areas of cover 108. Adhesive dispensing mechanism 143 includes a take-up spool 144, a supply spool 146, an application roller 148, and a guide roller 150. Supply spool 146 is disposed within plug-in cartridge housing 142 and is configured to support a roll of sheet adhesive (or adhesive tape) 154 that includes a pressure sensitive adhesive composition disposed on a carrier ribbon 152. Take-up spool 144 is configured to reel-in spent carrier ribbon 152. In operation, application roller 148 is placed against a surface of cover 108. Take-up spool 144 and supply spool 146 are coupled by a gear coupling mechanism. The gear coupling mechanism is configured so that take-up spool 144 reels in spent carrier ribbon 152 at a speed that is greater than the feed speed of supply spool 146, even when the winding diameter of carrier ribbon 152 on take-up spool 144 becomes greater than the winding diameter of adhesive tape roll 154. Excessive tension between take-up spool 144 and supply spool 146 is relieved by a conventional clutch mechanism between the gears of take-up spool 144 and supply spool 146. As adhesive dispenser 140 is drawn across the cover surface in a direction indicated by arrow 158, the tack properties of the pressure sensitive adhesive between application roller 148 and the cover surface releases a film of pressure sensitive adhesive from carrier ribbon 154 onto the cover surface.

As explained above, in some embodiments, the respective cartridge housings 74, 142 for the solid hot melt sheet adhesive 78 and the pressure sensitive adhesive tape 152 are configured to plug into respective receptacles in bookbinder 22 of finisher 14. In these embodiments, bookbinder 22 may be configured to obtain automatically an indication of the length of solid sheet adhesives remaining within each of the plug-in cartridge housings 74, 142. Bookbinder 22 also may be configured to replace automatically an exhausted adhesive dispenser with a new adhesive dispenser of an adhesive stack that has been loaded into bookbinder 22 based upon a signal received from a sensor. After each of the loaded adhesive dispensers has been exhausted, bookbinder 22 may display a notice indicating that another adhesive dispenser stack should be loaded into the system.

Figure 9:
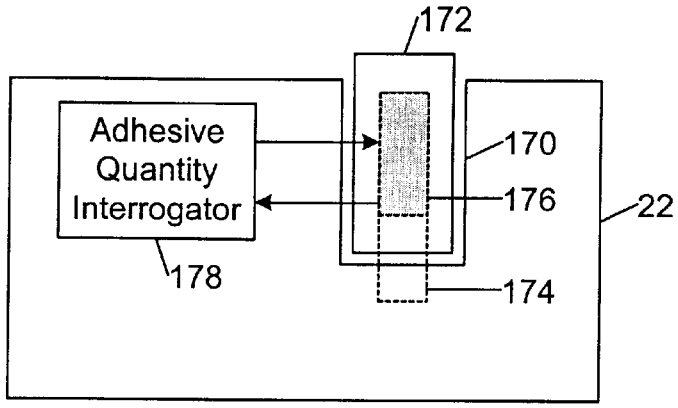
FIG. 9 is a block diagram of a bookbinder that includes a receptacle for receiving a plug-in cartridge housing of an adhesive dispenser and an adhesive quantity interrogator.

As shown in FIG. 9, bookbinder 22 may include a receptacle 170 that is configured to receive a plug-in cartridge housing 172 of an adhesive dispenser (e.g., hot melt adhesive dispenser 74 or pressure sensitive adhesive dispenser 142) that contains a length of solid sheet adhesive 174 wound into a roll 176. Bookbinder 22 also includes an adhesive quantity interrogator 178, which is configured to obtain an indication of the length of solid sheet adhesive 174 remaining within the plug-in cartridge housing 172. Based upon this length indication, bookbinder 22 may determine whether a sufficient amount of adhesive 174 is available to complete a current binding job, or whether the adhesive dispenser should be replaced.

Figure 10:
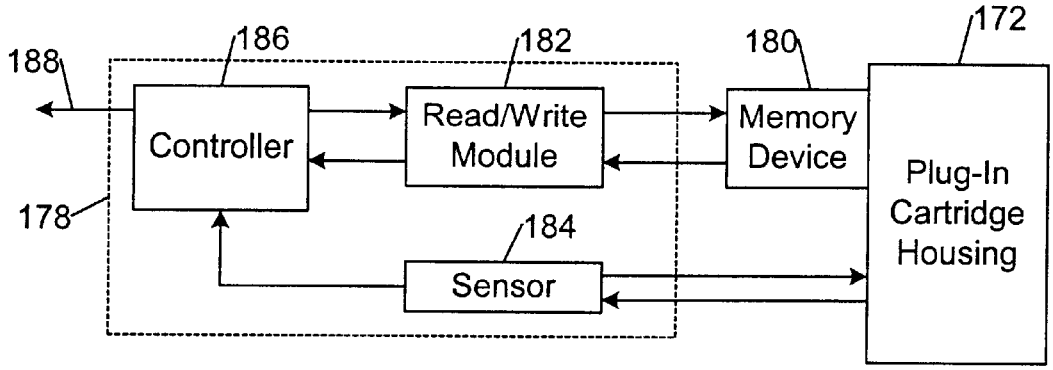
FIG. 10 is a block diagram of an adhesive quantity interrogator that is configured to interrogate a memory device that is attached to a plug-in cartridge housing of an adhesive dispenser.

Referring to FIG. 10, in one embodiment, a memory device 180 (e.g., a 256-bit 1-WIRE™ EEPROM available from Dallas Semiconductor of Dallas, Tex. U.S.A.) is mounted on plug-in cartridge housing 172 and adhesive quantity interrogator 178 includes a read/write module 182 that is configured to read information from and write information to memory device 180. Adhesive quantity interrogator 178 also includes a sensor 184 that is configured to obtain an indication of the length of solid sheet adhesive 174 dispensed from cartridge housing 172, and a controller 186 that is configured to control the operation of read/write module 182 and to communicate with bookbinder 22. In operation, memory device 180 initially may be programmed to store the length of adhesive contained in an unused adhesive cartridge. During use, controller 184 may update the length value stored in memory device 180 based upon an indication of the length of adhesive used obtained by sensor 184. As a result, the length of adhesive 174 remaining within cartridge housing 172 may be stored in memory device 180 and updated each time adhesive is dispensed. When the length value stored in memory device 180 is smaller than the length of adhesive needed to complete a particular binding job, controller 186 sends to an adhesive loading system of bookbinder 22 a signal 188 indicating that the adhesive dispenser should be replaced. In this way, adhesive quantity interrogator ensures that a current binding job may be completed properly. In addition, because an indication of the length of adhesive remaining is stored with adhesive cartridge 172, partially used adhesive cartridges may be inserted into bookbinder 22 and adhesive quantity interrogator 178 readily may determine the length of adhesive available for binding. This approach avoids the need to store adhesive availability information in a memory device of bookbinder 22. In addition to adhesive length information, memory device 180 also may be programmed to store other information, including an identifier corresponding to the type of adhesive contained within cartridge 172, an indication of the age of the adhesive, and quality control tracking information, such as an identifier corresponding to the location where the adhesive cartridge was manufactured and the manufacturing lot number.

Sensor 184 may obtain an indication of the length of solid sheet adhesive 174 dispensed from cartridge housing 172 directly, for example, by reading a rotary encoder that is coupled to the adhesive dispensing drive mechanism, or indirectly, for example, by obtaining a measurement of separation between clamps holding text body 24 while the text body sheets are being bound together by hot melt adhesive dispensed from adhesive dispenser 74.

Figure 11:
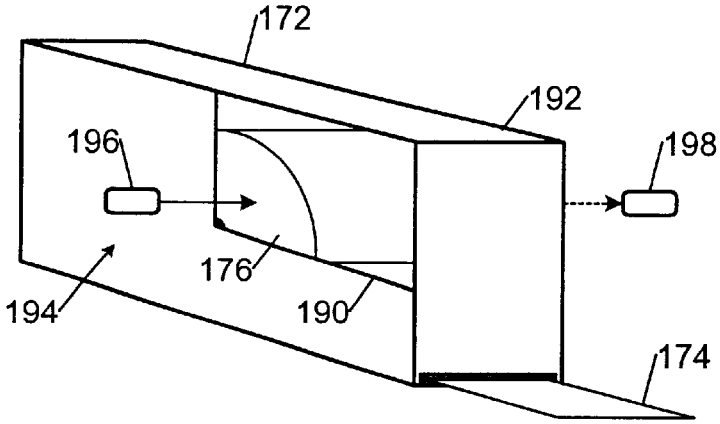
FIG. 11 is a diagrammatic perspective view of a plug-in cartridge housing having a window through which a sensor may optically sense when a length of solid sheet adhesive is nearly spent.

Referring to FIG. 11, in one embodiment, plug-in cartridge housing 172 includes a pair of windows 190, 192 through which a sensor 194 may optically sense when the solid sheet adhesive 174 is nearly spent. In particular, sensor 194 may include a transmitter 196 (e.g., a light-emitting diode) and a receiver 198 (e.g., a photodetector) that are disposed on opposite sides of cartridge 172. Transmitter 196 and receiver 198 are positioned with respect to adhesive roll 176 such that light emitted from transmitter 196 is detected by receiver 198 only after the amount of adhesive 174 remaining within cartridge 172 has dropped below a selected level (e.g., below 10% of the original unused adhesive quantity). Controller 186 or, alternatively, a controller of bookbinder 22, may be coupled to receiver 198 to determine when a light signal is detected by receiver 198. When such a signal is detected, bookbinder 22 may automatically replace the spent adhesive dispenser with a new adhesive dispenser of an adhesive stack that has been loaded into bookbinder 22, or bookbinder 22 may display a notice indicating that another adhesive dispenser stack should be loaded into the system.

In another embodiment, sensor 194 may include a single transceiver module that is configured to transmit light through window 190 and to detect light that reflects from the exposed side of adhesive roll 176. When reflected light is no longer detected, bookbinder 22 may automatically replace the spent adhesive dispenser with a new adhesive dispenser of an adhesive stack that has been loaded into bookbinder 22, or bookbinder 22 may display a notice indicating that another adhesive dispenser stack should be loaded into the system.

Figure 12:
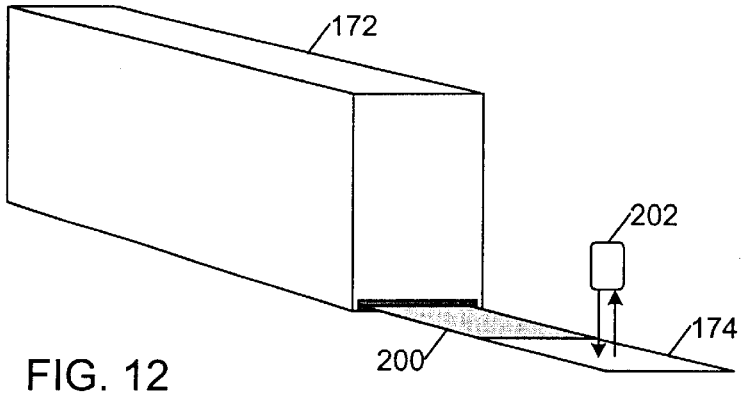
FIG. 12 is a diagrammatic perspective view of a plug-in cartridge housing containing a length of solid sheet adhesive having an interrogatable feature disposed near one end.

As shown in FIG. 12, in another embodiment, solid sheet adhesive 174 includes an exposed feature 200 that may be interrogated by a sensor 202. Feature 200 may be disposed near the end (e.g., at the 10% remaining mark) of the length of sheet adhesive 174 so that sensor 202 may sense when adhesive 174 is nearly spent. In one embodiment, interrogatable feature 200 may correspond to a change in the light response of the exposed surface of adhesive 174 (e.g., a region of different color or a region of different light reflectivity). In this embodiment, sensor 202 may be implemented as a conventional light transceiver module. In another embodiment, interrogatable feature 200 may correspond to a change in the magnetic response of the exposed surface of adhesive 174 (e.g., a magnetic strip). In this embodiment, sensor may be implemented as a conventional magnetic field sensor.

Figure 13:
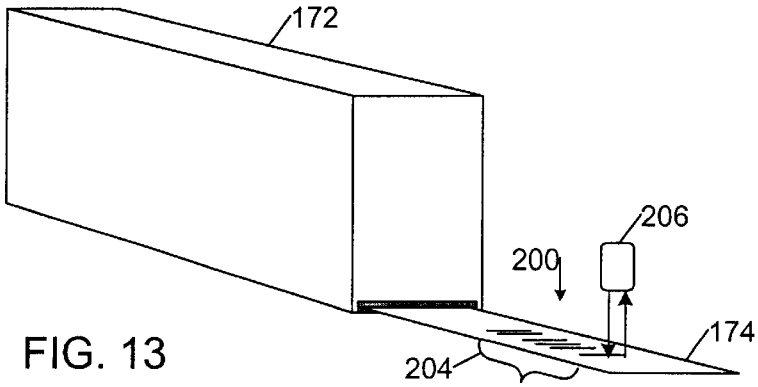
FIG. 13 is a diagrammatic perspective view of a plug-in cartridge housing containing a length of solid sheet adhesive having an information-containing symbol disposed near one end.

Referring to FIG. 13, in one embodiment, interrogatable feature 200 corresponds to an information-containing symbol 204 that may be read by an optical reader 206. Symbol 204 may be a conventional information-based indicium (e.g., a one- or two-dimensional bar code) that consists of a pattern of light and dark regions-disposed on the exposed surface of adhesive 174, and optical reader 206 may be a conventional optical reader (e.g., an optical scanner or a bar code reader). Symbol 204 may be oriented along the length of adhesive 174 as shown, or symbol 204 may be oriented along the width of adhesive 174. Symbol 204 may be disposed near one end of the length of adhesive 174 or a plurality of such symbols may be disposed periodically along the length of adhesive 174. Symbol 204 may store information relating to the amount of adhesive remaining within cartridge 172, as well as other information, including an identifier corresponding to the type of adhesive contained within cartridge 172, an indication of the age of the adhesive, and quality control tracking information, such as an identifier corresponding to the location where the adhesive cartridge was manufactured and the manufacturing lot number.

Figure 14A:
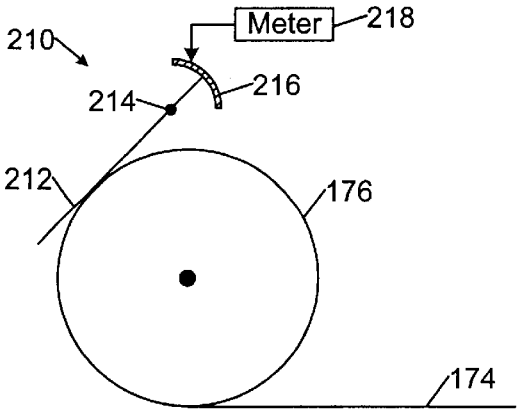
FIG. 14A is a diagrammatic side view of a roll of solid sheet adhesive and a sensor that is configured to sense when the adhesive is nearly spent based upon contact between the sensor and a surface of the roll of adhesive.
Figure 14B:
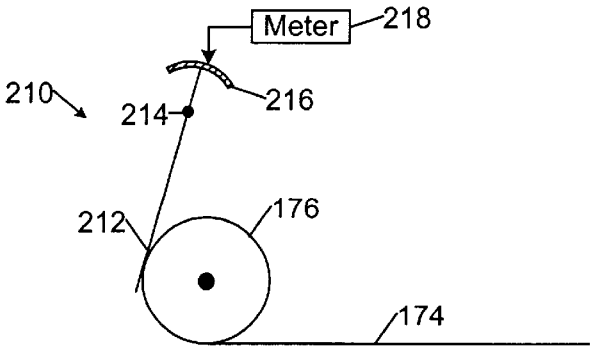
FIG. 14B is a diagrammatic side view of the roll of adhesive and sensor of FIG. 14A after a substantial length of the solid sheet adhesive has been dispensed from the roll.

Referring to FIGS. 14A and 14B, in another embodiment, a sensor 210 is configured to physically sense when the solid sheet adhesive 174 is nearly spent based upon contact between a probe 212 and a surface of the roll 176 of adhesive 174. In particular, probe 212 is configured to turn on a pivot 214 and is coupled to a turn angle marker 216, which may be read by a meter 218. In operation, one end of probe 212 is biased against the surface of adhesive roll 176. The angle at which probe 212 turns on pivot 214 and, consequently, the location on turn angle marker 216 where meter 218 reads the turn angle, is determined by the size of adhesive roll 176. As adhesive 174 is dispensed from roll 176, roll 176 becomes smaller and the angle measured by meter 218 varies. Angle marker 216 and meter 218 may be calibrated so that meter 218 may generate an indication of the amount of adhesive remaining based upon the measured turn angle. In one embodiment, angle marker 216 may be implemented as a potentiometer, and meter 218 may be implemented as an ohmmeter. In another embodiment, angle marker 216 may be implemented as an optical strip containing angle information encoded in a pattern of light and dark regions across the exposed surface, and meter 218 may be implemented as a conventional optical reader.

Other embodiments are within the scope of the claims.

What is claimed is:

1. An adhesive dispenser, comprising:

a plug-in cartridge housing configured to plug into a receptacle of a bookbinding system;

a length of solid sheet adhesive disposed within the plug-in cartridge housing and wound into a roll; and an indicator of the length of solid sheet adhesive remaining within the plug-in cartridge housing, wherein the indicator comprises a memory device mounted on the plug-in adhesive cartridge housing and storing an indication of the length of solid sheet adhesive remaining within the plug-in cartridge housing.

2. The adhesive dispenser of claim 1, wherein the memory device comprises a programmable memory.

3. The adhesive dispenser of claim 2, wherein the programmable memory is an EEPROM.

4. The adhesive dispenser of claim 1, wherein the stored indication of the length of solid sheet adhesive remaining within the plug-in cartridge housing is updatable.

5. The adhesive dispenser of claim 1, wherein the memory device further stores one or more of the following information: an adhesive type identifier; an adhesive age indication; a manufacturing location identifier; and a manufacturing lot number.

6. An adhesive dispenser, comprising:

a plug-in cartridge housing configured to plug into a receptacle of a bookbinding system;

a length of solid sheet adhesive disposed within the plug-in cartridge housing and wound into a roll; and an indicator of the length of solid sheet adhesive remaining within the plug-in cartridge housing, wherein the indicator comprises an interrogatable feature disposed on an exposed surface near only one end of the solid sheet adhesive to indicate that the solid sheet adhesive is nearly spent.

7. The adhesive dispenser of claim 6, wherein the interrogatable surface feature comprises a change in light response of the exposed surface of solid sheet adhesive.

8. The adhesive dispenser of claim 6, wherein the interrogatable surface feature comprises a magnetic indicator disposed near an end of the solid sheet adhesive.

9. The adhesive dispenser of claim 6, wherein the interrogatable feature is disposed at a location corresponding to a specified proportion of the remaining length of sheet adhesive.

10. An adhesive dispenser, comprising:

a plug-in cartridge housing configured to plug into a receptacle of a bookbinding system;

a length of solid sheet adhesive disposed within the plug-in cartridge housing and wound into a roll; and an indicator of the length of solid sheet adhesive remaining within the plug-in cartridge housing, wherein the indicator comprises an interrogatable surface feature comprising an information-containing symbol disposed on the exposed surface of the solid sheet adhesive.

11. The adhesive dispenser of claim 10, wherein the information-containing symbol is a bar code symbol.

12. The adhesive dispenser of claim 10, wherein the information-containing symbol stores an indication of the length of solid sheet adhesive remaining within the plug-in cartridge housing.

13. The adhesive dispenser of claim 10, wherein the information-containing symbol stores one or more of the following information: an adhesive type identifier; an adhesive age indication; a manufacturing location identifier; and a manufacturing lot number.

* * * * *